US010017366B2

(12) United States Patent
Running

(10) Patent No.: US 10,017,366 B2
(45) Date of Patent: Jul. 10, 2018

(54) CLAMP HAVING A LOAD-CLAMPING HYDRAULIC CYLINDER WITH MULTIPLE TELESCOPICALLY EXTENSIBLE STAGES ADAPTED TO APPLY LOAD CLAMPING FORCE ALTERNATIVELY RESPONSIVE TO LOAD-LIFTING FORCE OR LOAD SIZE

(71) Applicant: Cascade Corporation, Portland, OR (US)

(72) Inventor: Brent G. Running, Hood River, OR (US)

(73) Assignee: Cascade Corporation, Fairview, OR (US)

( * ) Notice: Subject to any disclaimer, the term of this patent is extended or adjusted under 35 U.S.C. 154(b) by 213 days.

(21) Appl. No.: 15/088,401

(22) Filed: Apr. 1, 2016

(65) Prior Publication Data

US 2017/0283228 A1 Oct. 5, 2017

(51) Int. Cl.
*B66F 9/18* (2006.01)
*B66F 9/22* (2006.01)

(52) U.S. Cl.
CPC ..... *B66F 9/183* (2013.01); *B66F 9/184* (2013.01); *B66F 9/22* (2013.01)

(58) Field of Classification Search
CPC ... B25J 13/08; B25J 15/04; B66F 9/22; B66F 9/183; B66F 9/184
See application file for complete search history.

(56) References Cited

U.S. PATENT DOCUMENTS 3,896,957 A 7/1975 Sinclair
3,905,635 A 9/1975 Esser
3,990,594 A * 11/1976 Olson ..... B66F 9/183 294/207
4,127,205 A 11/1978 Farmer et al.
4,227,850 A * 10/1980 Farmer ..... B66F 9/184 294/205
4,789,292 A 12/1988 Holcomb
6,454,511 B1 9/2002 Jordan et al.
2003/0017040 A1 * 1/2003 Jordan ..... B25J 13/082 414/636
2010/0089704 A1 * 4/2010 Petronek ..... B66F 9/183 187/224

FOREIGN PATENT DOCUMENTS

DE 10 2010 046 227 A1 12/2011
DE 102010046227 * 12/2011 ..... B22D 17/266
GB 801.006 A 9/1958

OTHER PUBLICATIONS

International Search Report and Written Opinion dated Apr. 20, 2017, International Application No. PCT/US16/69362, 14 pgs.

* cited by examiner

*Primary Examiner* — Thomas E Lazo
(74) *Attorney, Agent, or Firm* — Chernoff, Vilhauer, McClung & Stenzel, LLP

(57) ABSTRACT

A load-handling clamp mountable on a lift truck has one or more hydraulic clamping cylinders of the type having two or more sequentially extensible stages capable of applying either load-weight-responsive variable hydraulic load-clamping force or, alternatively, load-size-responsive variable hydraulic load-clamping force, without risking the clamp's dropping of a clamped load. The length of the hydraulic clamping cylinder(s) may in some applications extend generally forwardly from a supporting lift truck, and in other applications extend generally laterally from a supporting lift truck.

5 Claims, 2 Drawing Sheets

CLAMP HAVING A LOAD-CLAMPING HYDRAULIC CYLINDER WITH MULTIPLE TELESCOPICALLY EXTENSIBLE STAGES ADAPTED TO APPLY LOAD CLAMPING FORCE ALTERNATIVELY RESPONSIVE TO LOAD-LIFTING FORCE OR LOAD SIZE

CROSS-REFERENCE TO RELATED APPLICATIONS

None.

BACKGROUND OF THE INVENTION

This disclosure relates generally to hydraulic circuits for optimizing the handling of paper rolls or other objects by means of a lift truck-mounted load clamp capable of automatically applying load-weight-responsive variable hydraulic load-clamping force.

U.S. Pat. No. 6,454,511 discloses a prior electrical system for load weight-responsive hydraulic control of load-clamping force by electrically sensing load weight and automatically limiting maximum hydraulic load clamping force by a pressure relief valve variably controlled by an electrical controller in response to the sensed load weight.

US Patent Application Publication No. 2010/0089704 discloses a simpler mechanical type of system which does not require an electrical controller, and nevertheless is capable of automatically applying load-weight-responsive variable hydraulic load-clamping force. However this latter load weight-dependent clamping system was not previously considered usable in conjunction with a hydraulic clamping cylinder having more than a single extensible stage, because each additional successive stage of such a cylinder during cylinder extension has a progressively reduced pressure area resulting in a progressively reduced clamping force, which might cause the clamp to drop a clamped load.

SUMMARY OF THE PRESENT INVENTION

The present invention improves upon the foregoing latter mechanical type of load clamping system by utilizing one or more hydraulic clamping cylinders of the type having two or more sequentially extensible stages, as shown for example in U.S. Pat. Nos. 4,127,205 and 4,227,850, to apply load-weight-responsive variable hydraulic load-clamping force or, alternatively, load-size-responsive variable hydraulic load-clamping force, without risking the clamp's dropping of a clamped load. The length of the hydraulic clamping cylinder(s) may in some applications extend generally forwardly from a supporting lift truck, and in other cases extend generally laterally with respect to a supporting lift truck. The improved system can be used with one or more load-lifting cylinders having one or more load-lifting extensible stages. The improved system results in the following further advantages:

(1) automatically reduced clamping forces on smaller loads to prevent load damage;

(2) automatically faster clamp closure on smaller loads to increase load-handling production;

(3) ability to clamp a larger range of load sizes.

The foregoing and other objectives, features, and advantages of the invention may be more readily understood upon consideration of the following detailed description of the invention, taken in conjunction with the accompanying drawings.

DETAILED DESCRIPTION OF PREFERRED EMBODIMENT

In the following detailed description, certain specific preferred features are described to aid in understanding the invention. However the invention may be practiced in numerous ways without utilizing these specific features.

Figure 1:
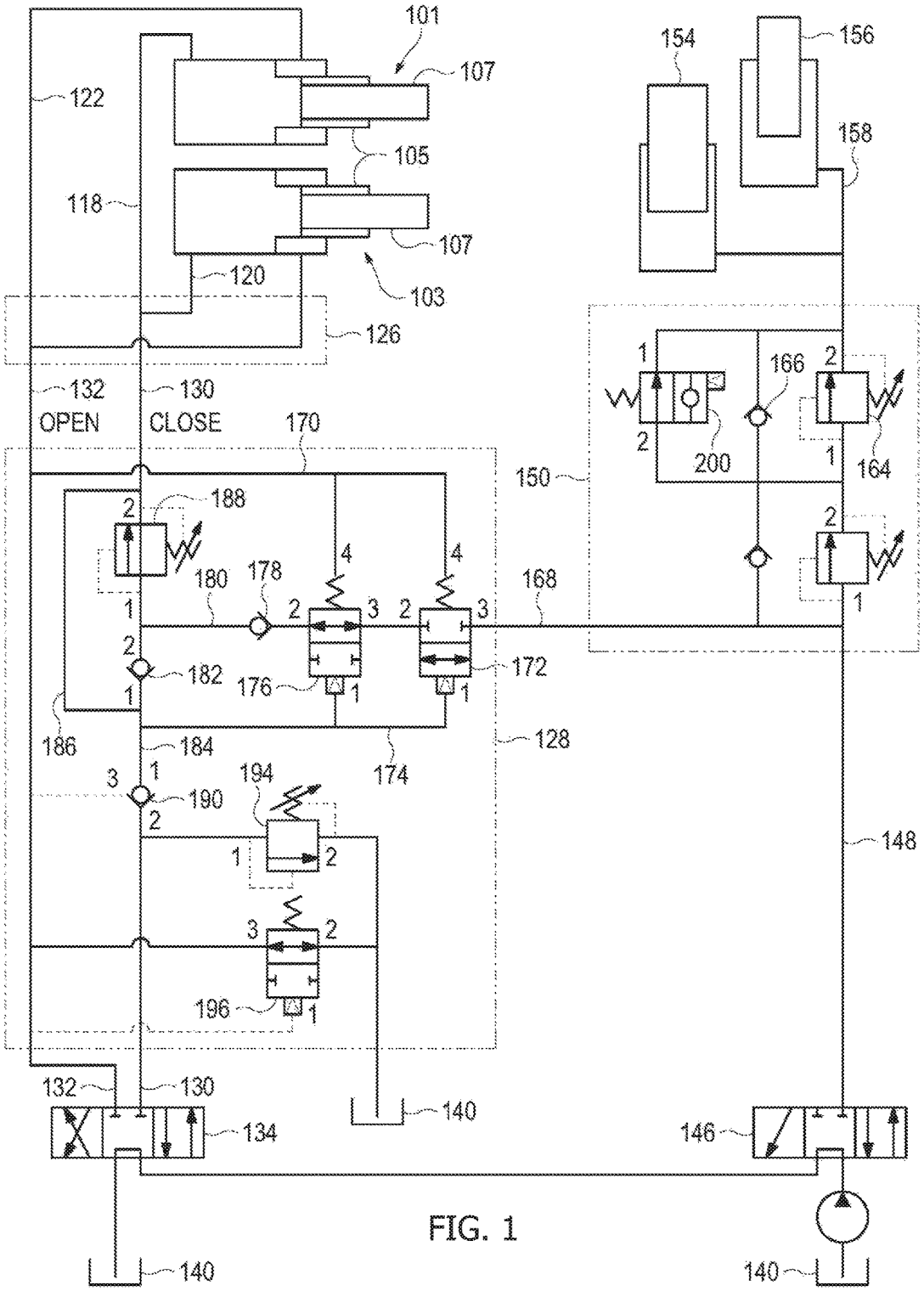
FIG. 1 is an example of a preferred form of hydraulic system usable in the present invention.

FIG. 1 shows a preferred embodiment of a hydraulic system which can be used in the present invention for advantageously controlling a load handling clamp of the type normally carried by a lift truck for handling paper rolls or other heavy loads. The hydraulic system is adapted for automatic variable load-weight-responsive control of load-clamping force on the load, where minimization of retracted hydraulic clamping actuator telescopic length, in combination with maximization of extended hydraulic clamping actuator telescopic length, is desirable to increase the size range of clamped loads which can be handled by the lift truck. Such system preferably includes one or more fluid power load clamping actuators such as 101, 103, each having two or more telescopic, sequentially extensible stages such as 105 and 107.

Each larger diameter stage 105 is the first to extend under hydraulic clamp-closing pressure, supplied through clamp-closing lines 118 and 120 to the larger pressurized areas of each stage 105. After maximum extension of the larger diameter stages 105, the respective corresponding smaller diameter stages 107 will extend with lesser force than the larger diameter stages 105 due to their smaller pressurized areas. The system preferably also includes at least one longitudinally-extensible fluid power load-lifting actuator having two or more telescopic, sequentially extensible stages 154 and 156. Preferably such load-lifting actuator has an extensible free lift stage 154 which raises the load without extending the lift truck's mast to facilitate load-lifting in low-overhead areas, and a main lift stage 156 which further raises the load to greater heights in higher-overhead areas while extending the lift truck's mast.

A load-clamping valve 134 controls the extension and retraction of the clamping actuators 101, 103, and a load-lifting valve 146 controls the extension and retraction of the load-lifting actuators 154 and 156. Such valves can be manually controlled or remotely controlled.

A load-clamping member (not shown) controllable by one or more fluid power actuators such as 101, 103, may comprise a paper roll clamp arm or any other type of load-clamping member. For the exemplary purposes of this disclosure, the load-lifting system will be further described in the context of a paper roll clamp having a pair of side-by-side load-clamping fluid power actuators each having two movably extensible and retractable stages 105 and 107 controlled in unison for movement simultaneously in a common direction by the fluid power actuators 101,103. In such arrangement, the fluid power actuators 101, 103 may be configured for closing the load-clamping members in unison as hydraulic fluid is introduced into the head sides of the fluid power actuators (or cylinders) 101, 103 via fluid lines [136,] 118 and 120 to extend the actuators by movement of the clamp valve spool 134 to the left in FIG. 1 with hydraulic fluid concurrently being exhausted from the opposite sides of the fluid power actuators 101, 103 via fluid lines 122 and 132. Movement of the clamp valve spool 134 to the right, on the other hand, correspondingly retracts the actuators 101, 103.

A two-way valve 196 is shown piloted from the load-clamp-opening line 132 causing the valve to move to a closed, no-flow position when the load-clamping selector valve 134 is moved to the right for increasing fluid pressure in the load-clamp-opening line 132.

Each of the fluid power actuators 101, 103 may additionally be controlled by a valve assembly 126, which can contain hydraulic circuitry such as a conventional flow divider-combiner valve (not shown) to cause equal volumetric flows through the power actuators 101 and 103 so that they operate in unison. The load-clamping valve assembly 126 may also include conventional pilot-operated check valves and associated circuitry for holding the power actuators in their load-clamping condition until released by opposing hydraulic pressure in the clamp-opening control lines 122 and 132.

The load-lifting system may include at least one fluid power lifting device which has at least a free lift stage 154 and a main lift stage 156. The lifting device 154, 156 may be a single, multiple stage fluid power device, or an assembly of fluid power devices. In either case, the fluid power lifting device is configured to have a free lift range of longitudinal movement for lifting the load-clamping members without extending the mast, and at least one main lift range of longitudinal movement whereby the mast extends as the lifting device extends. As shown schematically, the free lift stage 154 requires a lower fluid pressure in line 158 for extensible actuation than does the main lift stage 156 because the free lift stage 154 piston has a greater pressure surface area than the main lift stage 156 piston. Consequently, increasing hydraulic fluid flow in line 158 causes extension of the free lift stage 154 until its end of travel, after which further fluid flow in line 158 causes the main lift stage 156 to extend.

The hydraulic valve circuitry of the system is shown grouped into three different modules 128, 150, and 152, although various components may be grouped differently or grouped into a different number of modules. In summary, the hydraulic valve circuitry grouped into the module 128 comprises circuitry for receiving a sensed load weight in line 168 from hydraulic circuitry associated with the lifting devices 154, 156, and for using the sensed load weight for weight-responsive control of the load-clamping actuators 101 and 103.

The hydraulic valve circuitry grouped into the valve assemblies 150 and 152 include circuitry for ensuring that the sensed load weight received in line 168 is equalized so as to be substantially independent of the longitudinally-extensible positions of the lifting device 154, 156, and for enabling the cylinder or cylinders that comprise the lifting device 154, 156 to act as accumulators when the load-clamping 134 and load-lifting 146 selector valves are closed, thereby providing the load-lifting system with full-time automatic weight-responsive force control of the load-clamping members.

The hydraulic valve circuitry shown in the valve assembly 128 includes load-clamp-closing circuitry for receiving hydraulic fluid from the load-clamping selector valve 134. For example, an operator of a lift truck equipped with a load-lifting system for handling paper rolls may initiate closure of the load-clamping members by moving the load-clamping selector valve 134 to the left in the figure to cause hydraulic fluid to flow into a clamp-closing line 130, unseat a pilot-operated valve 190, and continue flowing through line 130 and load-clamping valve 126 to lines 118 and 120 to extend the clamping cylinders 101 and 103 simultaneously. As the fluid is introduced into the load-clamp-closing line 130, hydraulic fluid is concurrently exhausted through the load-clamp-opening line 132. As the load-clamping members close upon the load, hydraulic pressure in the load-clamp-closing line 130 increases to a desired threshold (or starting) gripping pressure by an adjustable pressure relief valve 194 or other suitable valve. For example, the pressure relief valve 194 may be set to limit the load-clamp-closing line 130 to 650 psi so that hydraulic fluid from the load-clamping selector valve 134 exceeding this limit is returned to the lift truck reservoir 140 rather than allowed to continue to increase the gripping pressure imposed on the clamped load.

As the fluid pressure increases in the load-clamp-closing line 130 up to the setting of the pressure relief valve 194, a pilot line 174 receives the pressure at 184 so as to control the position of two pilot-operated, adjustably spring biased two-position valves 172, 176, which are used to selectively control the range of fluid pressure accepted from line 168 and from the hydraulic circuitry associated with the lifting device 154, 156. The valve 172 is preferably used to set a minimum pressure limit below which the load-clamp-closing circuitry is hydraulically decoupled from the load-lifting circuitry, and the valve 176 is preferably used to set a maximum clamping pressure limit above which the load-clamp-closing circuitry is hydraulically decoupled from the load-lifting circuitry. The two-position valve 176 is shown as a normally open valve, allowing fluid flow unless piloted by line 174 into a closed or no fluid flow state, whereas the two-position valve 172 is shown as a normally closed valve, blocking fluid flow unless piloted by line 174 into an open fluid flow state. Each of the two-position valves 172, 176 is spring biased so as to remain in its normal state until the pilot line pressure exceeds the setting of the spring resistance. Pressure in the load-clamp-opening line 132 and spring override line 170 causes the valves 172, 176 to return to their normal state. Pressure in the load-clamp-opening line 132 also unseats the check valve 190 via pilot line 192 allowing fluid to drain from the load-clamp-closing circuitry.

Preferably the spring resistance setting for valve 172 is less than the threshold or starting pressure setting for the pressure relief valve 194, yet high enough to prevent the load-clamping members from drifting downward as they are being closed for gripping the load. Typical spring resistance settings may be 600 psi for the spring in valve 172 and 1800 psi for the spring in valve 176. Once the fluid pressure sensed at 184 reaches the spring setting of valve 172, or 600 psi, for example, valve 172 opens to allow fluid pressure to be sensed downstream of now open valve 172, downstream of the normally open valve 176, and also downstream of check valve 178. When both valves 172 and 176 are open, fluid pressure from line 168, and thereby the weight of the load, may be sensed at 180. Until valve 172 opens, the pressure in the load-clamp-closing circuitry is decoupled from pressure in the hoist lines 148 and 168. Only when both of the two-position valves 176 and 172 are open is fluid from line 168 able to be received into the load-clamp-closing circuitry at 180. The check valve 178 prevents fluid from the load-clamp-closing circuitry from flowing through line 168 back into the load-lifting circuitry.

The check valve 182 prevents fluid from the line 168 from flowing upstream in the load-clamp-closing circuitry, instead forcing fluid to flow through the pressure regulating valve 188. The pressure regulating valve 188 may be used to adjust the clamping pressure applied by the load-clamping members in relation to weight-proportional fluid pressure received through the line 168. For example, for a lifting system having larger capacity fluid power actuators 101, 103, the weight-proportional hydraulic pressure received from the line 168 may result in excessive gripping forces exerted on the load. In such cases the pressure regulating valve 188 may be used to reduce the maximum pressure available for gripping the load. Other factors such as the fragility and stability of certain types of loads, the size and capacity of the load-lifting cylinder or cylinders comprising the lifting device 154, 156, and, as will be described in greater detail below, the pressure intensification effects of pressure equalizing circuitry 150 associated with the lifting device 154, 156, may require reducing the clamping pressure received from line 168.

Any suitable type of pressure regulating valve variably responsive to the pressure in line 168 can be used in the position of valve 188, including one or more pilot-controlled relief valves or pressure reducing valves.

During a load-lifting operation, after the threshold pressure is reached for clamping the load, the load-clamping selector valve 134 is returned to its centered, unactuated position, and the hoist or load-lifting selector valve 146 is moved to allow hydraulic fluid to flow through hoist actuating line 148 for extending the lifting device 154, 156 to lift the load. If the fluid conduits 148, 158, and 168 are simply interconnected together, the relationship between load weight sensed at line 168 and the hydraulic pressure in the line 168 would vary depending upon the position of the lifting device 154, 156 because lifting the load in free lift mode 154 requires less hydraulic pressure than lifting the same load in main lift mode 156. The main lift stage 156 may, for example, require an additional 400 psi of hydraulic pressure for activation. Consequently, the load weight signal available from such a lifting system varies depending upon whether the lifting device is in free lift or main lift.

The hydraulic valve circuitry grouped into the valve assemblies 150 and 152 includes circuitry for ensuring that the sensed load weight received in line 168 is equalized so as to be substantially independent of the longitudinally-extensible position of the lifting device 154, 156. As shown, the exemplary valve assembly 150 includes a pressure-differential regulating valve 164 that compensates for the difference in actuation pressures between free lift cylinder 154 and main lift cylinder 156. The pressure regulating valve 164 may be adjusted, for example, to reduce the pressure in line 158 by 400 psi to operate the free lift cylinder 154, as compared with the higher downstream pressure required in line 158 to operate the smaller-area piston of the main lift cylinder 156. During operation of the free lift cylinder 154 the pressure in line 148 is effectively intensified by the valve 164 so as to equalize the sensed load weight in line 168 to that which naturally occurs during operation of the main lift cylinder 156.

The check valve 166 enables the cylinder or cylinders that comprise the lifting device 154, 156 to act as accumulators when the load-clamping 134 and load-lifting 146 selector valves are closed, thereby providing the load-lifting system with full-time automatic weight-responsive force control of the load-clamping members. If, for example, there is an increase in the magnitude of sensed load weight, the check valve 166 enables fluid from the lifting device 154, 156 to automatically increase fluid to the load-clamp-closing circuitry through line 168 without concurrent actuation of either the load-clamping 134 or load-lifting 146 selector valves.

Similarly, if there is a decrease in the gripping force exerted on the load, the check valve 166 enables fluid from the lifting device 154, 156 to automatically increase fluid to the load-clamp-closing circuitry without concurrent actuation of either the load-clamping 134 or load-lifting 146 selector valves.

Figure 2:
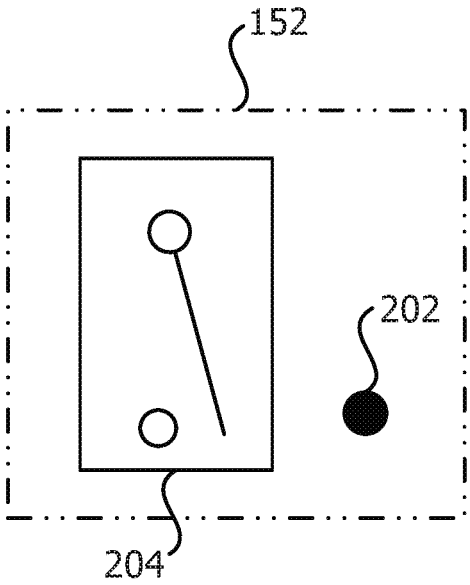
FIG. 2 is an example of a switch assembly which can interact with the hydraulic system of FIG. 1.

A switch assembly 152 as shown in FIG. 2 may comprise a switch 204 that is responsive to the extensible position of the mast and provides an electrical activation signal to a normally open, solenoid-activated two-way valve 200 in valve assembly 150. The solenoid-activated two-way valve 200 is shown in an unactivated, open position. A switch triggering element or other device such as, for example, a target 202 may be mounted to a cross member of the movable main lift section of the mast, and a switch 204 (such as a proximity switch) may be mounted on the lower or fixed portion of the mast. The proximity switch 204 provides an activation signal causing the solenoid-activated two-way valve 200 to move to an activated, closed position throughout extension of the lifting device 154, 156 in its free lift 154 range of movement. After the free lift stage 154 reaches its upper end of travel, the main lift cross member moves upwardly away from the fixed portion of the mast, thereby separating the switch elements and causing de-activation of the solenoid-activated two-way valve 200, which in turn moves the two-way valve 200 to its open position. This enables fluid to bypass the equalizing valve 164, eliminating its pressure-reducing effect. As additional hydraulic fluid is introduced through line 148 to continue lifting the load, the fluid is able to bypass the equalizing valve 164 so that the higher pressure in line 148 is available for actuating the main lift stage 156 of the lifting device 154, 156. Even though the switch 204 and solenoid valve 200 are electrical, they are both mounted on portions of the mast or lift truck which are fixed and do not move in response to mast extension, thereby avoiding the need for any electrical conductor which must move in response to mast extension and would therefore be exposed to hazards and durability problems.

Other types of valves or components may alternatively be used, without the need for electrical components, for bypassing the equalizing valve 164 when the lifting device 154, 156 is in its main lift 156 range of motion. For example, instead of an electrically operated solenoid valve 200, a mechanically operated valve could be used which is physically responsive to upward movement of the main lift cross member.

When retracting the lifting device 154, 156 in its main lift 156 range of movement, hydraulic fluid is permitted to flow through the two-way (or bypassing) valve 200. Once the two-way valve 200 becomes closed fluid is able to bypass the equalizing valve 164 by flowing through the check valve 166, which in turn provides a path for hydraulic fluid to exhaust from the free lift stage 154 as the lifting device 154, 156 is further retracted.

Although a two-stage (i.e. free lift and main lift) load-lifting device has been described, a single stage lifting device can alternatively be used. Alternatively, additional main lift stages may be accommodated by adding equalization and bypassing valves to compensate for the higher actuation pressures required so that the sensed load weight at line 168 remains independent of the longitudinally-extensible position of the lifting device. For example, if the lifting device includes a second main lift stage beyond the single main lift stage 156 shown in FIG. 1, another equalization valve may be added in series with equalizing valve 164, and another valve for bypassing the added equalizing valve may be added for actuation of the additional (second) main lift stage when the first main lift stage 156 reaches its end of travel.

The terms and expressions which have been employed in the foregoing specification are used in as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. A hydraulic load-clamping and load-lifting system including at least one load-clamping hydraulic cylinder of a type having at least first and second sequentially extensible stages capable of applying a clamping force to a load in response to a source of pressurized hydraulic fluid, said first stage having a first fluid pressure-receiving area greater than a second fluid pressure-receiving area of said second stage, said first stage being capable of applying a first clamping force to said load automatically variably dependent on a hydraulic pressure supporting a weight of said load applied to said first fluid pressure-receiving area, and said second stage being capable of applying a second clamping force less than said first clamping force to said load automatically dependent on a size of said load.

2. The system of claim 1, said second stage being capable of applying said second clamping force in response to a maximum extension of said first stage.

3. The system of claim 1 further including a load-lifting hydraulic cylinder which lifts said load in response to said hydraulic pressure supporting said weight of said load.

4. The system of claim 3 wherein said load-lifting hydraulic cylinder is of a type having at least two sequentially extensible stages.

5. The system of claim 1 wherein said load-clamping hydraulic cylinder is operably mountable on a materials handling lift truck such that a length of said load-clamping hydraulic cylinder extends generally forwardly from said lift truck.

* * * * *